US005116391A

United States Patent [19]

Moriki et al.

[11] Patent Number: 5,116,391

[45] Date of Patent: May 26, 1992

[54] CURVED SURFACE RUBBING APPARATUS

[75] Inventors: Yasumitsu Moriki, Tokyo; Hirotomo Numakura, Kawasaki, both of Japan

[73] Assignee: Maruma Jyusharyo Kabushiki Kaisha, Tokyo, Japan

[21] Appl. No.: 701,609

[22] Filed: May 14, 1991

Related U.S. Application Data

[63] Continuation of Ser. No. 399,771, Aug. 28, 1989, abandoned.

[30] Foreign Application Priority Data

May 31, 1989 [JP] Japan ..... 1-63910

[51] Int. Cl.[5] ..... B24B 13/00

[52] U.S. Cl. ..... 51/26; 51/54; 51/216 LP

[58] Field of Search ..... 51/26, 216 LP, 54, 55, 51/57, 119, 74 R, 156

[56] References Cited

U.S. PATENT DOCUMENTS

| | | | |
|---|---|---|---|
| 2,279,798 | 4/1942 | Shelburne | 51/26 |
| 2,378,696 | 6/1945 | Fulmer | 51/26 |
| 2,381,449 | 8/1945 | Holman | 51/26 |
| 2,431,638 | 9/1938 | Passmore | 51/26 |
| 3,898,267 | 8/1975 | Kobayashi | 51/7 |
| 3,898,767 | 8/1975 | Kobayashi | 51/7 |
| 4,085,553 | 4/1978 | Prunier | 51/216 LP |
| 4,232,485 | 11/1980 | Eadon-Allen | 51/55 |
| 4,257,194 | 3/1981 | Cailloux | 51/57 |
| 4,333,274 | 6/1982 | Eadon-Allen | 51/160 |
| 4,357,864 | 11/1982 | Salete-Garces | 51/156 |
| 4,392,331 | 7/1983 | Schimitzek et al. | 51/55 |
| 4,513,537 | 4/1985 | Spurling et al. | 51/119 |
| 4,558,480 | 12/1985 | Okafuji et al. | 51/74 R |

*Primary Examiner*—Bruce M. Kisliuk
*Assistant Examiner*—Lawrence Cruz
*Attorney, Agent, or Firm*—Emmanuel J. Lobato; Robert E. Burns

[57] ABSTRACT

A polishing apparatus in which one of two workpieces to be polished or abraded which contact each other at respective arcuate or spherical surfaces, is placed on a fixed base and turned or fixed in a horizontal plane with the other workpiece held under pressure by a retainer provided on a gate type frame which can be swung around the center of curvature of the contact surfaces of the two workpieces by a swinging unit capable of varying the range of swinging movement of the gate-type frame. The center of the swinging movement of this frame can be varied by changing the position of two pivot-connected block units vertically in a stepless manner and the position of the retainer to a reference axis can be varied. This enables the apparatus to be applied to workpieces having arbitrary curved surfaces to be polished and of different dimensions.

5 Claims, 3 Drawing Sheets

CURVED SURFACE RUBBING APPARATUS

This is a continuation of application Ser. No. 07/399,771, filed Aug. 28, 1989, now abandoned.

BACKGROUND OF THE INVENTION

1. Field of the Invention

This invention relates to an apparatus for rubbing two members, which contact each other at their spherical or arcuate surfaces, against each other to polish the same, and more particularly to a curved surface rubbing apparatus used for the maintenance and repairing of the parts of a construction machine.

2. Description of the Prior Art

The devices and machines having spherical contact members therein include a mechanical seal, a hydraulic pump and a hydraulic motor.

For example, the spherical contact surfaces of a cylinder block and a valve plate in a hydraulic pump, or the similar surfaces of a cradle and a rocker cam therein become rough or are worn non-uniformly while they are used for a long period of time, to cause the performance of the pump to be deteriorated.

Especially, it has been demanded that these surfaces have a higher accuracy so as to cope with the recent increase of the pressure used in the above-mentioned kind of devices, and the time and labor required to carry out the maintenance work for these surfaces tends to increase.

In addition, such spherical contact members produced by various manufacturers have various sizes and curvatures and are a large number of types, so that the maintenance work for these members becomes increasingly inefficient.

SUMMARY OF THE INVENTION

Object

An object of the present invention is to provide a curved surface rubbing apparatus capable of being applied to spherically contacting members of various radii of curvature, and polishing the contact surfaces thereof efficiently by rubbing them against each other to obtain very high curvature accuracy.

Structure

The apparatus of the present invention consists of a means for fixing or turning in a horizontal plane a first member of the two members which contact each other at their curved surface, a gate type frame which holds under pressure from the upper side a second member surface contacting the first member, and which is linked to a swinging unite, fixed support posts set up firmly in opposition to a pair of leg members of the gate type frame, and a pair of units of pivot-connected blocks, each of which units is composed of two blocks connected at their respective intermediate portions to each other by a pivot and engaged with a corresponding leg member and fixed post, so that the vertical position of the blocks can be regulated freely, the gate type frame is swung with the pivot-connected blocks positioned at the center of curvature of the contact surfaces of the first and second members.

DESCRIPTION OF THE PREFERRED EMBODIMENTS

Figure 1:
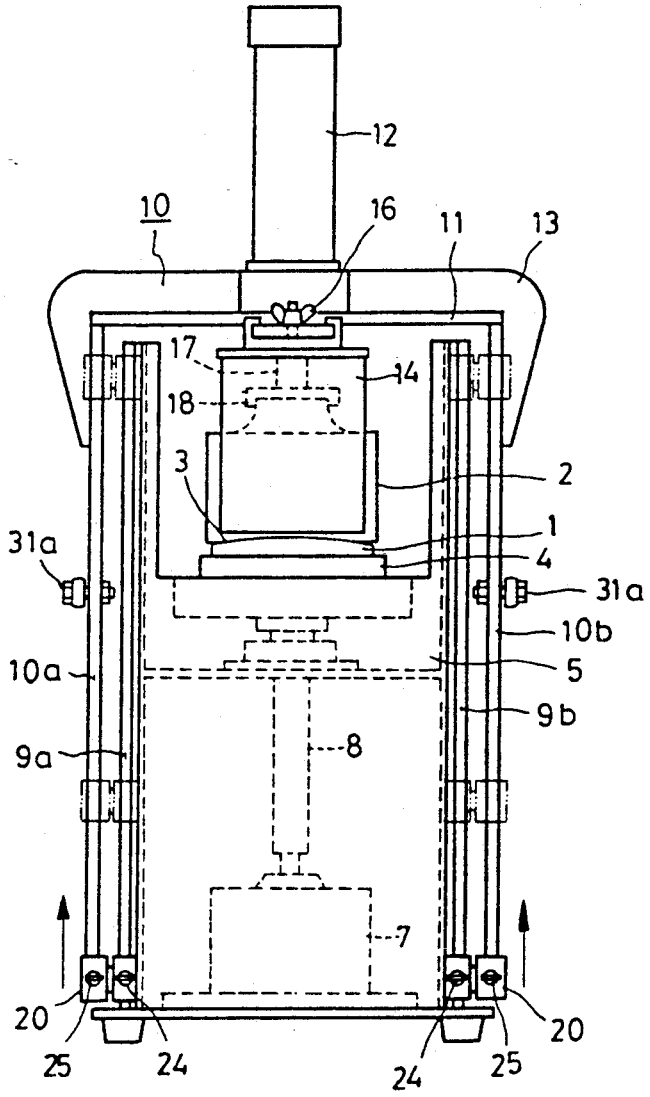
FIG. 1 is a front elevation of the apparatus according to the present invention.
Figure 2:
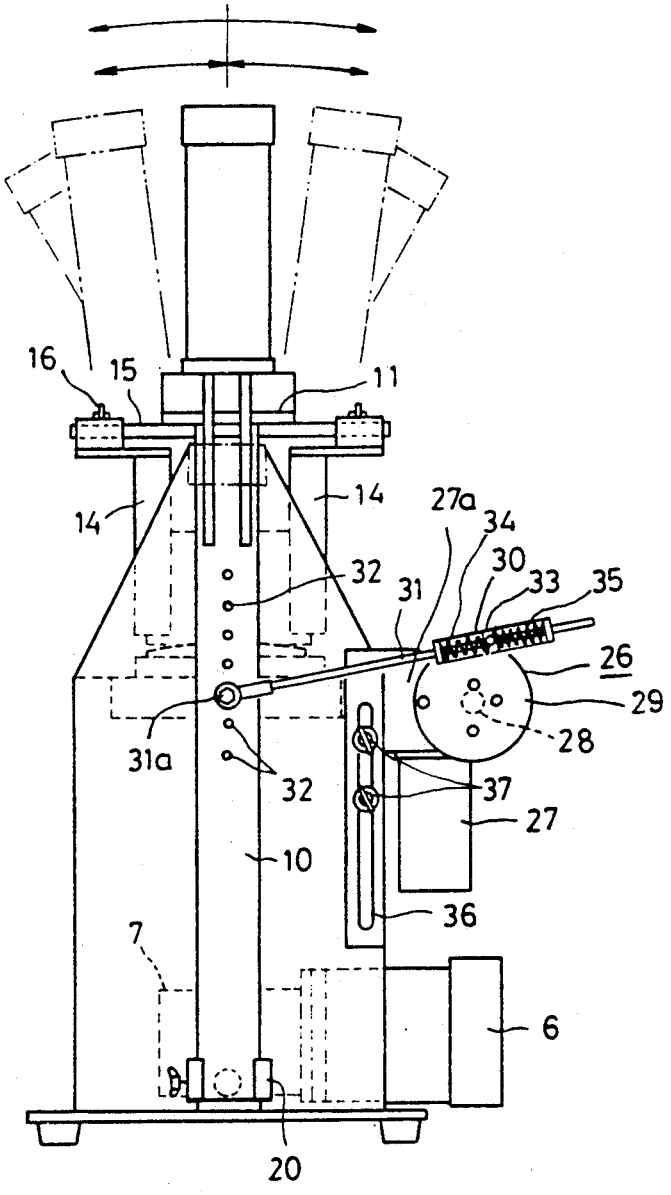
FIG. 2 is a side elevation of the apparatus.

A reference numeral 1 denotes a valve plate, which constitutes a first member, of a hydraulic pump, and 2 a cylinder block constituting a second member, the radius of the curved contact surfaces 3 of these two members being 300–500 mm.

A reference numeral 4 denotes a turntable supporting and adapted to turn the first member, and a fixed base 5 is provided therein with a variable speed motor 6, a speed reducer 7 and a vertical transmission shaft 8.

The reference numerals 9*a*, 9*b* denote fixed support posts set up on both sides of the fixed base, and 10 a gate type frame in which leg members 10*a*, 10*b*, arranged in parallel with the outer side surfaces of the fixed support posts, are connected together by a top plate 11, on which a pressure cylinder 12 is provided.

A reference numeral 13 denotes a reinforcing member, a pair of retainer members 14 hold both sides of the second member and are adapted to be positioned along slide bars 15, using positioning nuts 16.

A reference numeral 17 denotes a cylinder rod, and 18 a chuck applying a required level of pressing force constantly to the second member.

Figure 3:
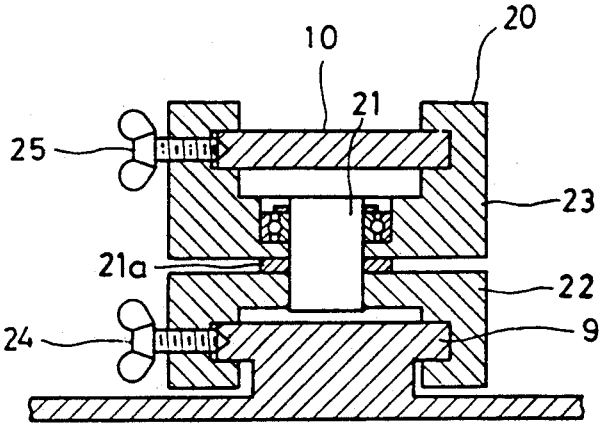
FIG. 3 is a horizontal section of a principal portion of pivot-connected blocks.

A reference numeral 20 denotes pivot-connected block units, each of which includes two C-shaped blocks 22, 23, as shown in FIG. 3, which support both end portions of a pivot 21 so that the pivot can be turned, and which are engaged with the corresponding fixed support post 9 and leg member 10 so that the blocks 22, 23 can slide in a stepless manner. Fixing means 24, 25 are provided, consisting of nuts by which the blocks 22, 23 are adjustably to their individual support post 9 and leg member 10 in which different positions upwardly of the base.

It is preferable that the side surfaces of the fixed support posts 9 and leg members 10 be provided with V-shaped recesses in which the front end portions of the nuts are to be fitted.

The graduations, not shown, for use in positioning the pivot-connected block units are accurately in different positions as shown in phantom in FIG. 1, are also provided. A reference numeral 21*a* denotes a spacer.

The pivot-connected block units 20 are fixed with regard to the center of the arc of the contact surface 3 of a workpiece so that the contact surface 3 is swung about that center as described herein.

A reference numeral 26 denotes a swinging unit 27 a variable speed motor, 27*a* a rotational directions converter, 28 a transmission shaft, 29 rotary discs, and 30 rod guides fixed to the discs 29. Direction of rotation changes of the discs 29 is effected by the converter 27*a*.

A reference numeral 31 denotes swingable rods provided symmetrically with respect to the leg members 10*a*, 10*b*. One end portion of each of the swingable rods 31 is joined to the corresponding leg member by a bolt 31*a* insertable into on of a plurality of bolt holes 32 provided in the leg member, and the other end portions thereof is supported on the corresponding rod guide, the intermediate portion of the swingable rod 31 is joined to an annular member 33 positioned between left and right shock absorbing springs, 34, 35 provided in the rod guide 30.

Each of the rod guides 30 is fixed to the relative disc 29 so that the distance between the rod guide and the center of the disc 29 can be varied, whereby the range of a swinging movement of the gate type frame can be varied. The swinging unit 26 as a whole is adapted to be moved vertically and set using set screw 37 in a selected position with respect to the fixed base by a slide guide 36.

When fixing position 31*a* of the swingable rods 31, the fixing position of the rod guides 30 with respect to the rotary discs 29 and the height of the swinging unit with respect to the fixed base are set suitably, the swinging angle and the swinging range (for example, a symmetric or asymmetric range with respect to a vertical axis) of the leg members 10*a*, 10*b*, i.e. gate type frame 10 can be varied.

In the above-described apparatus, the first member or workpiece 1 is swung around the center of its curved contact surface within a range of angles set by the swinging unit. Accordingly, the contact surfaces of these workpieces are displaced wholly and polished owing to the effect of abrasives as these members are rubbed against each other. If the first member is fixed, the polishing of an arcuate surface can be done.

Figure 5:
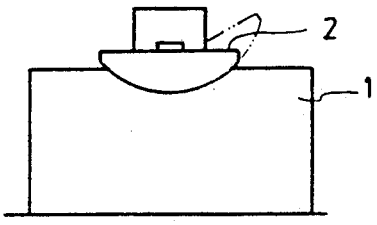
FIG. 5 illustrates another embodiment having negative curved contact surfaces.
Figure 4:
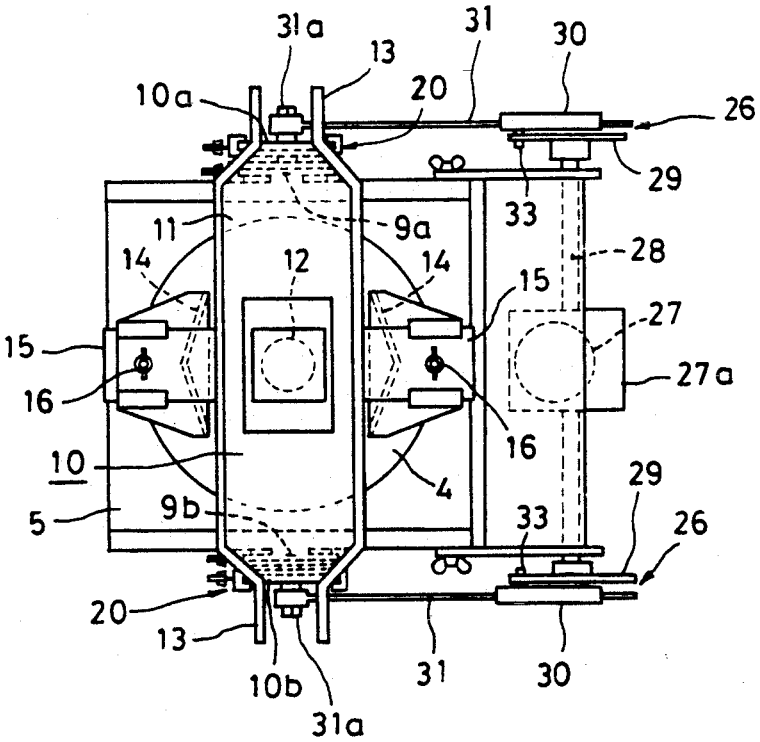
FIG. 4 is a top view of the apparatus.

The center of such a swinging movement, i.e. the position of the pivot-connected block units 20 can be varied freely along the fixed support posts and leg members. Therefore, the rubbing and polishing of members or workpieces having complementary concave and convex curved surfaces consisting, for example, of a cradle and a rocker cam as first and second members, respectively, shown in FIG. 5, can also be done.

The apparatus according to the present invention can thus be applied in a stepless manner to members the contact surfaces of which have various curvatures and various curved condition. Therefore, it has a wide range of applications and permits a position regulating or changing operation to be carried out easily, so that the apparatus has a high operation efficiency.

Owing to these characteristics, curved contact surfaces with a sufficiently high curvature accuracy can be obtained during the maintenance and repairing of a device having curved contact surfaces, in a short period of time without using any man power.

What is claimed is:

1. Apparatus for polishing, lapping and abrading different paired workpieces constituting two workpieces having respective arcuate contact surfaces to be placed in contact for rubbing contact movement therebetween, the respective arcuate contact surfaces constituting surfaces of curvature having respective centers of arbitrary radii of curvature, the apparatus comprising a first mount for removably mounting thereon a first workpiece of said two workpieces with a surface of curvature having a respective center of arbitrary radii of curvature, a second mount for removably mounting thereon a second workpiece of said two workpieces with a surface of curvature having a respective center of arbitrary radii of curvature and in close contact with the surface of curvature of the first workpiece, swing means for effecting relative swinging movement between said first mount and said second mount to effect relative movement between the surfaces of curvature of the two workpieces while in close contact, the swing means having means for supporting said first mount and having pivot means variably positionable in different axial positions along a longitudinal reference axis for variably spacing the first mount from the second mount in dependence upon a dimension between the centers of arbitrary radii of curvature of the workpieces for thereby accommodating different dimensioned paired workpieces and different dimensioned pairs of workpieces, means for defining said reference axis, a swing unit for reciprocally swinging the swing means on said pivot means reciprocally and laterally of said reference axis for effecting swinging of said first mount with said first workpiece thereon to effect a swinging movement of the first workpiece relative to the second workpiece with said surfaces of curvature in close contact, and means for variably positioning said first mount on said swing means relative to said reference axis spaced from said pivot means so that the first mount is swingable reciprocally symmetrically or asymmetrically of said reference axis and the first workpiece thereon is swingable reciprocally about the centers of the arbitrary radii of curvature when the surfaces of curvature of the workpieces are in close contact.

2. Apparatus according to claim 1, in which said swing comprises a pressing unit for applying pressure continuously effective on said first mount while the surfaces of curvature are in contact to maintain the surfaces of curvature in close contact.

3. Apparatus according to claim 1, in which said swing unit comprises means for variably setting the extent of swinging movement of the swing means laterally of said reference axis to thereby define the extent of swinging movement of the first workpiece relative to the second workpiece.

4. Apparatus according to claim 1, including a rotatably driven spindle supporting said second mount driven rotationally when the surfaces of curvature of said two workpieces are in close contact.

5. Apparatus according to claim 1, in which said second mount is a turntable rotatably driven while said workpieces are in close contact.

* * * * *